US007435203B2

(12) United States Patent
Anderson et al.

(10) Patent No.: US 7,435,203 B2
(45) Date of Patent: Oct. 14, 2008

(54) STRIDE ADJUSTMENT PROGRAM

(75) Inventors: Timothy T. Anderson, Antioch, IL (US); Gregory A. Bahnfleth, Crystal Lake, IL (US); Rachel Lara Abigail Buckley, North Barrington, IL (US); Juliette C. Daly, Chicago, IL (US); Thomas J. Fuller, Chicago, IL (US); Ming Jiang, Villa Park, IL (US); Gregory A. Joseph, Naperville, IL (US); Karen Jean Knauf, Lombard, IL (US); Elena A. Martynenko, Lombard, IL (US); Craig R. Norman, Longmont, CO (US); Lisa Marie Nowak, Cary, IL (US)

(73) Assignee: Brunswick Corporation, Lake Forest, IL (US)

( * ) Notice: Subject to any disclaimer, the term of this patent is extended or adjusted under 35 U.S.C. 154(b) by 802 days.

(21) Appl. No.: 10/934,428

(22) Filed: Sep. 7, 2004

(65) Prior Publication Data

US 2005/0043145 A1 Feb. 24, 2005

Related U.S. Application Data

(63) Continuation-in-part of application No. 10/923,053, filed on Aug. 23, 2004, and a continuation-in-part of application No. 10/787,788, filed on Feb. 26, 2004, and a continuation-in-part of application No. 09/835,672, filed on Apr. 16, 2001, now Pat. No. 6,846,272.

(60) Provisional application No. 60/450,812, filed on Feb. 27, 2003, provisional application No. 60/501,988, filed on Sep. 11, 2003.

(51) Int. Cl.
*A63B 69/18* (2006.01)
*A63B 22/04* (2006.01)
*A63B 22/00* (2006.01)

(52) U.S. Cl. ..... 482/52; 482/4; 482/51; 482/9

(58) Field of Classification Search ..... 482/51–54, 482/57, 70, 79–80
See application file for complete search history.

(56) References Cited

U.S. PATENT DOCUMENTS

| | | | | |
|---|---|---|---|---|
| 6,248,046 | B1 * | 6/2001 | Maresh et al. | 482/57 |
| 6,572,512 | B2 * | 6/2003 | Anderson et al. | 482/51 |
| 6,776,740 | B1 * | 8/2004 | Anderson et al. | 482/54 |
| 6,846,272 | B2 * | 1/2005 | Rosenow et al. | 482/52 |
| 6,899,659 | B2 * | 5/2005 | Anderson et al. | 482/54 |
| 7,101,316 | B2 * | 9/2006 | Rosenow et al. | 482/52 |
| 7,179,204 | B2 * | 2/2007 | Anderson et al. | 482/54 |

* cited by examiner

*Primary Examiner*—Steve R Crow
(74) *Attorney, Agent, or Firm*—Michael B. McMurry

(57) ABSTRACT

In an elliptical step exercise apparatus where stride length can be varied the various user programs can take advantage of this feature to provide for an enhanced workout. A control system can be used to implement a preprogrammed exercise routine such as a hill program where stride is shortened as the user goes up a simulated hill and lengthened as the user goes down the hill. In an interval training program, stride length can be increased and decreased at periodic intervals. In a cross training program, stride length can be decreased when the user is pedaling backwards and increased when the user is pedaling forwards.

18 Claims, 14 Drawing Sheets

10
34
38
68
40
44
46
12
80
82
32
50
154
84
42
86
47
510
48
88
90
RPM
96
98
LOAD RESISTORS
110
CONSOLE
MESSAGE CENTER
92
100
102
POWER CONTROL BOARD
MICROPROCESSOR
94
SPEAKER
122
LED DISPLAY
DATA INPUT CENTER
106
104
POWER TRANSFORMER ASSEMBLY
136
152
HEALTH CLUB COMMUNICATIONS SYSTEM BOARD
148
146
162
150
TELEMETRY RECEIVER
HEART RATE DIGITAL SIGNAL PROCESSOR BOARD
144
144'
HEART RATE SENSING PAD
HEART RATE SENSING PAD
140
140'
164
CENTRAL COMPUTER SYSTEM

STRIDE ADJUSTMENT PROGRAM

CROSS-REFERENCE TO RELATED APPLICATIONS

This application is a continuation in part of U.S. Non-Provisional patent applications Ser. No. 10/923,053, filed Aug. 23, 2004; Ser. No. 10/787,788, filed Feb. 26, 2004; and Ser. No. 09/835,672, filed Apr. 16, 2001 now U.S. Pat. No. 6,846,272 and claims priority on U.S. Provisional Patent Applications Ser. No. 60/450,812, filed Feb. 27, 2003 and Ser. No. 60/501,988, filed Sep. 11, 2003.

FIELD OF THE INVENTION

This invention generally relates mechanisms to control exercise equipment and in particular to programs for controlling stride adjustment of elliptical exercise equipment.

BACKGROUND OF THE INVENTION

There are a number of different types of exercise apparatus that exercise a user's lower body by providing a generally elliptical stepping motion. These elliptical stepping apparatus provide advantages over other types of exercise apparatuses. For example, the elliptical stepping motion generally reduces shock on the user's knees as can occur when a treadmill is used. In addition, elliptical stepping apparatuses tend to exercise the user's lower body to a greater extent than, for example, cycling-type exercise apparatuses. Examples of elliptical stepping apparatuses are shown in U.S. Pat. Nos. 3,316,898; 5,242,343; 5,383,829; 5,499,956; 5,529,555, 5,685,804; 5,743,834, 5,759,136; 5,762,588; 5,779,599; 5,577,985, 5,792,026; 5,895,339, 5,899,833, 6,027,431, 6,099,439, 6,146,313, and German Patent No. DE 2 919 494.

A feature of some elliptical stepping apparatus is the ability to adjust stride length. Naturally, different people have different stride lengths and the exercise apparatus and it is desirable to accommodate each user so that they have a more comfortable and efficient workout. Existing elliptical stepping machines can compensate for people who have different stride lengths to a limited extent. However, such machines are not able to change the stride length during the operation of the device which can be a disadvantage. For example, existing elliptical stepping machines are not able to cope with the effect of increasing foot speed to result longer stride lengths. As a result, a problem with elliptical exercise machines is that they are not able to adjust horizontal stride length to compensate for various machine operating parameters or user exercise programs.

SUMMARY OF THE INVENTION

It is therefore an object of the invention to provide a mechanism for adjusting stride length in an elliptical type machine in order to compensate or respond to various machine operating parameters or exercise.

A further object of the invention is to use an adjustable stride mechanism and a control system to compensate for machine operating parameters such as pedal speed or direction.

An additional object of the invention is to use an adjustable stride mechanism and program logic in the control system of an elliptical stepper machine to implement various exercise programs that utilize varying stride lengths. Such programs can include a hill program, a random program, an interval program and a cross training program that includes changing direction of the stepping motion.

DETAILED DESCRIPTION OF THE INVENTION

Figure 1:
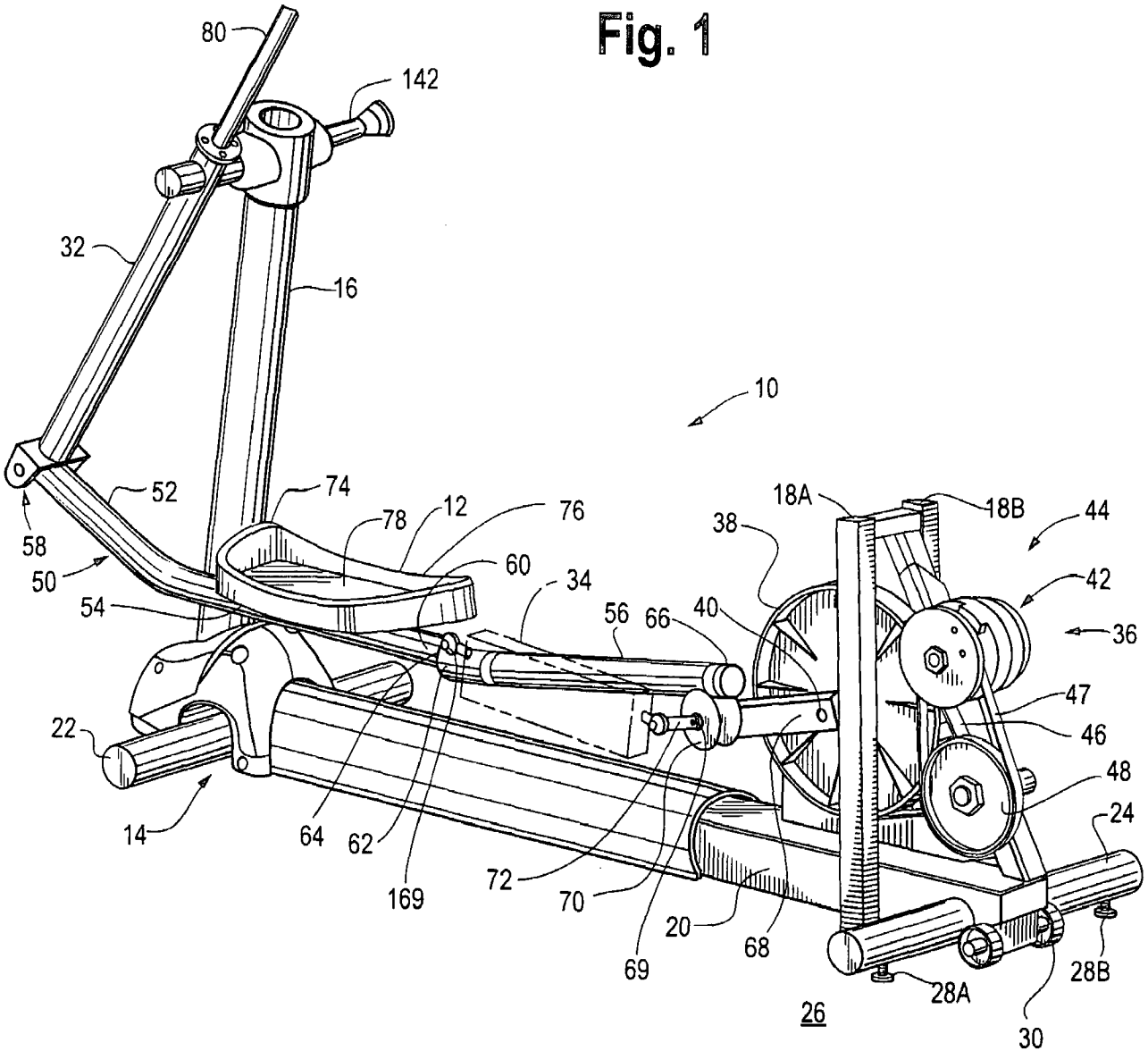
FIG. 1 is a side perspective view of an elliptical stepping exercise apparatus.

FIG. 1 depicts a representive example of an elliptical step exercise apparatus 10 of the type that can be modified to have the capability of adjusting the stride or the path of the foot pedal 12. The exercise apparatus 10 includes a frame, shown generally at 14. The frame 14 includes vertical support members 16, 18A and 18B which are secured to a longitudinal support member 20. The frame 14 further includes cross members 22 and 24 which are also secured to and bisect the longitudinal support member 20. The cross members 22 and 24 are configured for placement on a floor 26. A pair of levelers, 28A and 28B are secured to cross member 24 so that if the floor 26 is uneven, the cross member 24 can be raised or lowered such that the cross member 24, and the longitudinal support member 20 are substantially level. Additionally, a pair of wheels 30 are secured to the longitudinal support member 20 of the frame 14 at the rear of the exercise apparatus 10 so that the exercise apparatus 10 is easily moveable.

The exercise apparatus 10 further includes the rocker 32, an attachment assembly 34 and a resistance or motion controlling assembly 36. The motion controlling assembly 36 includes the pulley 38 supported by vertical support members 18A and 18B around the pivot axle 40. The motion controlling assembly 36 also includes resistive force and control components, including the alternator 42 and the speed increasing transmission 44 that includes the pulley 38. The alternator 42 provides a resistive torque that is transmitted to the pedal 12 and to the rocker 32 through the speed increasing transmission 44. The alternator 42 thus acts as a brake to apply a controllable resistive force to the movement of the pedal 12 and the movement of the rocker 32. Alternatively, a resistive force can be provided by any suitable component, for example, by an eddy current brake, a friction brake, a band brake or a hydraulic braking system. Specifically, the speed increasing transmission 44 includes the pulley 38 which is coupled by the first belt 46 to the second double pulley 48. The second double pulley 48 is then connected to the alternator 42 by a second belt 47. The speed increasing transmission 44 thereby transmits the resistive force provided by the alternator 42 to the pedal 12 and the rocker 32 via the pulley 38. The pedal lever 50 includes a first portion 52, a second portion 54 and a third portion 56. The first portion 52 of the pedal lever 50 has a forward end 58. The pedal 12 is secured to the top surface 60 of the second portion 54 of the pedal lever 50 by any suitable securing means. In this apparatus 10, the pedal 12 is secured such that the pedal 12 is substantially parallel to the second portion of the pedal lever 54. A bracket 62 is located at the rearward end 64 of the second portion 54. The third portion 56 of the pedal lever 50 has a rearward end 66.

In this particular example of an elliptical step apparatus, the crank 68 is connected to and rotates about the pivot axle 40 and a roller axle 69 is secured to the other end of the crank 68 to rotatably mount the roller 70 so that it can rotate about the roller axle 69. The extension arm 72 is secured to the roller axle 69 making it an extension of the crank 68. The extension arm 72 is fixed with respect to the crank 68 and together they both rotate about the pivot axle 40. The rearward end of the attachment assembly 34 is pivotally connected to the end of the extension arm 72. The forward end of the attachment assembly 34 is pivotally connected to the bracket 62.

The pedal 12 of the exercise apparatus 10 includes a toe portion 74 and a heel portion 76 so that the heel portion 76 is intermediate the toe portion 74 and the pivot axle 40. The pedal 12 of the exercise apparatus 10 also includes a top surface 78. The pedal 12 is secured to the top surface 60 of the pedal lever 50 in a manner so that the desired foot weight distribution and flexure are achieved when the pedal 12 travels in the substantially elliptical pathway as the rearward end 66 of the third portion 56 of the pedal lever 50 rolls on top of the roller 70, traveling in a rotationally arcuate pathway with respect to the pivot axle 40 and moves in an elliptical pathway around the pivot axle 40. Since the rearward end 66 of the pedal lever 50 is not maintained at a predetermined distance from the pivot axis 40 but instead follows the elliptical pathway, a more refined foot motion is achieved. It should be understood however that the invention can be implemented on other configurations of elliptical step apparatus having a variety of mechanisms for providing elliptical foot motion including the devices described in the patents referenced above as well as such machines shown in U.S. Pat. No. 6,176,814.

Figure 2:
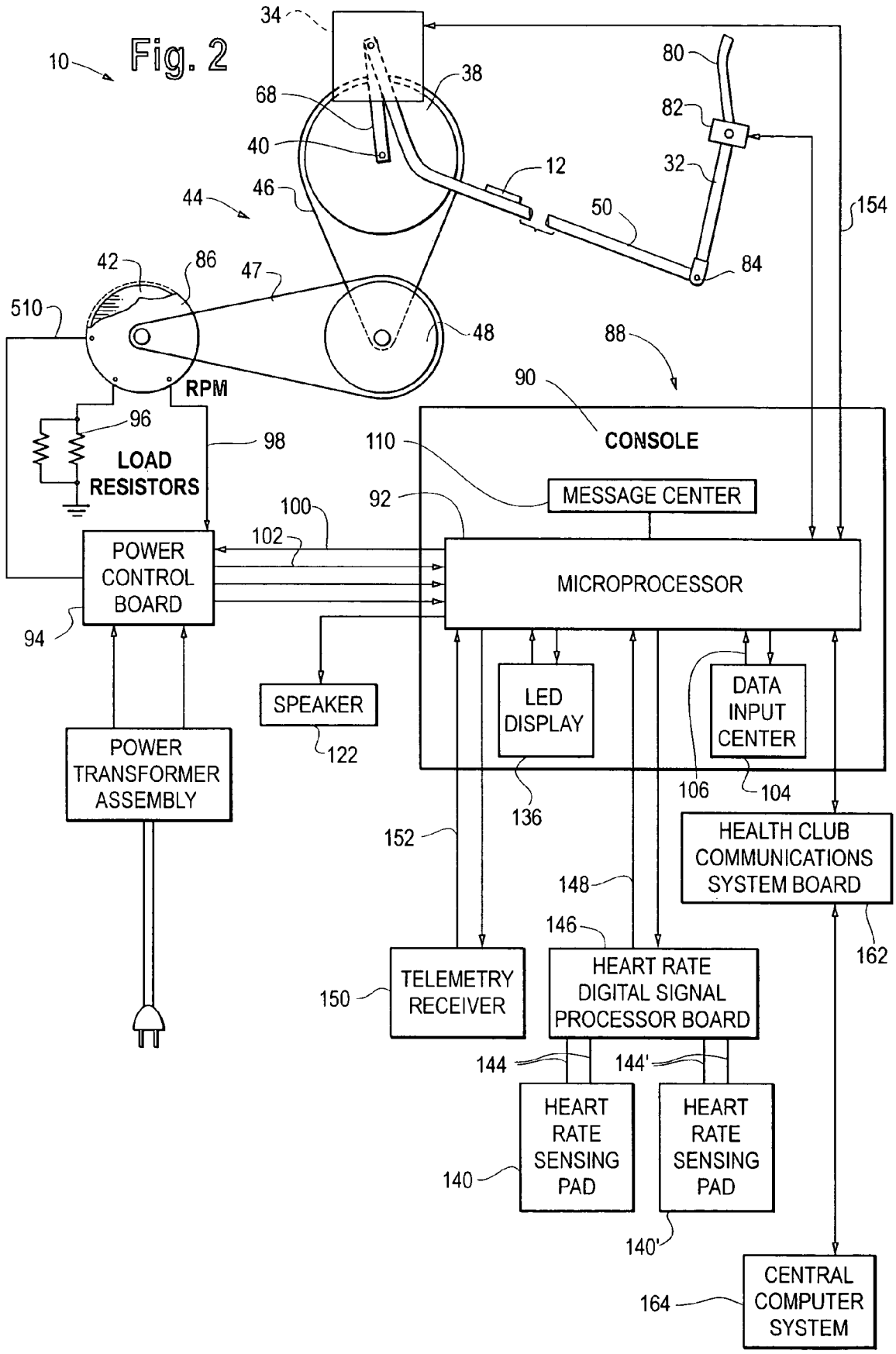
FIG. 2 is a schematic and block diagram of representative mechanical and electrical components of an example of an elliptical stepping exercise apparatus in which the method of the invention can be implemented.

FIG. 2 is a combination schematic and block diagram that provides an environment for describing the invention and for simplicity shows in schematic form only one of two pedal mechanisms typically used in an elliptical stepping exercise apparatus such as the apparatus 10. In particular, the exercise apparatus 10 described herein includes motion controlling components which operate in conjunction with an attachment assembly to provide an elliptical stepping exercise experience for the user. Included in this example of an elliptical stepping exercise apparatus 10 are the rocker 32, the pedal 12 secured to the pedal lever 50, the pulley 38 supported by the vertical support members 18A and 18B and which is rotatable on the pivot axle 40. This embodiment also includes an arm handle 80 that is connected to the rocker 32 at a pivot point 82 on the frame of the apparatus 10. The crank 68 is generally connected to one end of the pedal lever 50 by an attachment assembly represented by the box 34 and rotates with the pulley 38 while the other end of the pedal lever 50 is pivotally attached to the rocker 32 at the pivot point 84.

The apparatus 10 as represented in FIG. 2 also includes resistive force and control components, including the alternator 42 and the speed increasing transmission 44 that includes the pulley 38. The alternator 42 provides a resistive torque that is transmitted to the pedal 12 and to the rocker 32 through the speed increasing transmission 44. The alternator 42 thus acts as a brake to apply a controllable resistive force to the movement of the pedal 12 and the movement of the rocker 32. Alternatively, a resistive force can be provided by any suitable component, for example, by an eddy current brake, a friction brake, a band brake or a hydraulic braking system. Specifically, the speed increasing transmission 44 includes the pulley 38 which is coupled by a first belt 46 to a second double pulley 48. A second belt 47 connects the second double pulley 48 to a flywheel 86 of the alternator 42. The speed increasing transmission 44 thereby transmits the resistive force provided by the alternator 42 to the pedal 12 and the rocker 32 via the pulley 38. Since the speed increasing transmission 44 causes the alternator 42 to rotate at a greater rate than the pivot axle 40, the alternator 42 can provide a more controlled resistance force. Preferably the speed increasing transmission 44 should increase the rate of rotation of the alternator 42 by a factor of 20 to 60 times the rate of rotation of the pivot axle 40 and in this embodiment the pulleys 38 and 48 are sized to provide a multiplication in speed by a factor of 40. Also, size of the transmission 44 is reduced by providing a two stage transmission using pulleys 38 and 48.

FIG. 2 additionally provides an illustration of a control system 88 and a user input and display console 90 that can be used with elliptical exercise apparatus 10 or other similar elliptical exercise apparatus to implement the invention. In this particular embodiment of the control system 88, a microprocessor 92 is housed within the console 90 and is operatively connected to the alternator 42 via a power control board 94. The alternator 42 is also operatively connected to a ground through load resistors 96. A pulse width modulated output signal on a line 98 from the power control board 94 is controlled by the microprocessor 92 and varies the current applied to the field of the alternator 42 by a predetermined field control signal on a line 100, in order to provide a resistive force which is transmitted to the pedal 12 and to the arm 80. When the user steps on the pedal 12, the motion of the pedal 12 is detected as a change in an RPM signal which represents pedal speed on a line 102. It should be noted that other types of speed sensors such as optical sensors can be used in machines of the type 10 to provide pedal speed signals. Thereafter, as explained in more detail below, the resistive force of the alternator 42 is varied by the microprocessor 92 in accordance with the specific exercise program selected by the user so that the user can operate the pedal 12 as previously described.

Figure 3:
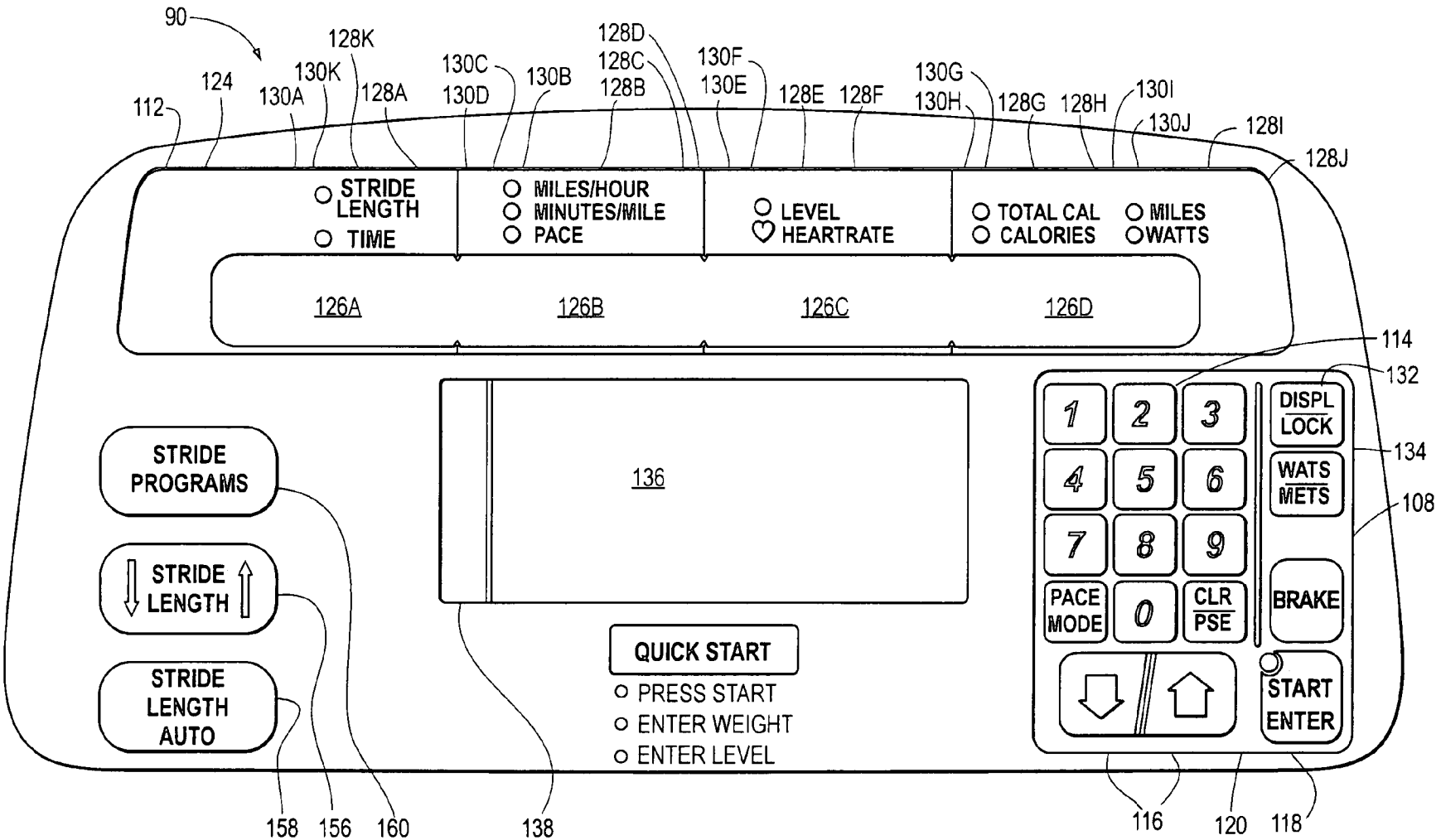
FIG. 3 is a plan layout of a display console for use with the elliptical exercise apparatus shown in FIG. 2.

The alternator 42 and the microprocessor 92 also interact to stop the motion of the pedal 12 when, for example, the user wants to terminate his exercise session on the apparatus 10. A data input center 104, which is operatively connected to the microprocessor 92 over a line 106, includes a brake key 108, as shown in FIG. 3, that can be employed by the user to stop the rotation of the pulley 38 and hence the motion of the pedal 12. When the user depresses the brake key 108, a stop signal is transmitted to the microprocessor 92 via an output signal on the line 106 of the data input center 104. Thereafter, the field control signal 100 of the microprocessor 92 is varied to increase the resistive load applied to the alternator 42. The output signal 98 of the alternator provides a measurement of the speed at which the pedal 12 is moving as a function of the revolutions per minute (RPM) of the alternator 42. A second output signal on the line 102 of the power control board 94 transmits the RPM signal to the microprocessor 92. The microprocessor 92 continues to apply a resistive load to the alternator 42 via the power control board 94 until the RPM equals a predetermined minimum which, in the preferred embodiment, is equal to or less than 5 RPM.

In this embodiment, the microprocessor 92 can also vary the resistive force of the alternator 42 in response to the user's input to provide different exercise levels. A message center 110 includes an alpha-numeric display screen 112, shown in FIG. 3, that displays messages to prompt the user in selecting one of several pre-programmed exercise levels. In the illustrated embodiment, there are twenty-four pre-programmed exercise levels, with level one being the least difficult and level 24 the most difficult. The data input center 104 includes a numeric key pad 114 and a pair of selection arrows 116, shown in FIG. 3, either of which can be employed by the user to choose one of the pre-programmed exercise levels. For example, the user can select an exercise level by entering the number, corresponding to the exercise level, on the numeric keypad 114 and thereafter depressing a start/enter key 118. Alternatively, the user can select the desired exercise level by using the selection arrows 116 to change the level displayed on the alpha-numeric display screen 112 and thereafter depressing the start/enter key 118 when the desired exercise level is displayed. The data input center 104 also includes a clear/pause key 120, show in FIG. 3, which can be pressed by the user to clear or erase the data input before the start/enter key 118 is pressed. In addition, the exercise apparatus 10 includes a user-feedback apparatus that informs the user if the data entered are appropriate. In this embodiment, the user feed-back apparatus is a speaker 122, that is operatively connected to the microprocessor 92. The speaker 122 generates two sounds, one of which signals an improper selection and the second of which signals a proper selection. For example, if the user enters a number between 1 and 24 in response to the exercise level prompt displayed on the alpha-numeric screen 112, the speaker 122 generates the correct-input sound. On the other hand, if the user enters an incorrect datum, such as the number 100 for an exercise level, the speaker 122 generates the incorrect-input sound thereby informing the user that the data input was improper. The alpha-numeric display screen 112 also displays a message that informs the user that the data input was improper. Once the user selects the desired appropriate exercise level, the microprocessor 92 transmits a field control signal on the line 100 that sets the resistive load applied to the alternator 42 to a level corresponding with the pre-programmed exercise level chosen by the user.

The message center 110 displays various types of information while the user is exercising on the apparatus 10. As shown in FIG. 3, the alpha-numeric display panel 124, shown on FIG. 3, is divided into four sub-panels 126A-D, each of which is associated with specific types of information. Labels 128A-K and LED indicators 130A-K located above the sub-panels 126A-D indicate the type of information displayed in the sub-panels 126A-D. The first sub-panel 126A displays the time elapsed since the user began exercising on the exercise apparatus 10 or the current stride length of the apparatus 10. One of the LED indicators 130A or 130K is illuminated depending if time or stride length is being displayed. The second sub-panel 126B displays the pace at which the user is exercising. In the preferred embodiment, the pace can be displayed in miles per hour, minutes per mile or equivalent metric units as well as RPM. One of the LED indicators 130B-130D is illuminated to indicate in which of these units the pace is being displayed. The third sub-panel 126C displays either the exercise level chosen by the user or, as explained below, the heart rate of the user. The LED indicator 130F associated with the exercise level label 128E is illuminated when the level is displayed in the sub-panel 126C and the LED indicator 130E associated with the heart rate label 128F is illuminated when the sub-panel 126C displays the user's heart rate. The fourth sub-panel 126D displays four types of information: the calories per hour at which the user is currently exercising; the total calories that the user has actually expended during exercise; the distance, in miles or kilometers, that the user has "traveled" while exercising; and the power, in watts, that the user is currently generating. In the default mode of operation, the fourth sub-panel 126D scrolls among the four types of information. As each of the four types of information is displayed, the associated LED indicators 130G-J are individually illuminated, thereby identifying the information currently being displayed by the sub-panel 126D. A display lock key 132, located within the data input center 104, shown in FIG. 2, can be employed by the user to halt the scrolling display so that the sub-panel 126D continuously displays only one of the four information types. In addition, the user can lock the units of the power display in watts or in metabolic units ("mets"), or the user can change the units of the power display, to watts or mets or both, by depressing a watts/mets key 134 located within the data input center 104.

It should be appreciated, that the control and display mechanisms shown in FIG. 2 only provide a representative example of such mechanisms and that there are a large number of such control and display systems that can be used to implement the invention.

Stride Length Adjustment Mechanisms

The ability to adjust the stride length in an elliptical step exercise apparatus is desirable for a number of reasons. First, people, especially people with different physical characteristics such as height, tend to have different stride lengths when walking or running. Secondly, the length of an individuals stride generally increases as the individual increases his walking or running speed. As indicated in U.S. Pat. Nos. 5,743,834 and 6,027,43 as well as the patent applications identified in the cross reference to related applications above, there are a number of mechanisms for changing the geometry of an elliptical step mechanism in order to vary the path the foot follows in this type of apparatus.

FIGS. 4-5, 6A-D, 7A-D and 8A-D depict a stride adjustment mechanism 166 which can be used to remotely vary the stride length without the need to adjust the length crank 68 and thus is particularly useful in implementing the invention. Essentially, the stride adjustment mechanism 166' replace the stroke link used to move the pedal lever 50 in earlier machines of the type shown in FIG. 1. This approach permits adjustment of stride length independent of the motion of the machine 10 regardless as to whether the machine 10 is stationary, the user is pedaling forward, or pedaling in reverse. One of the significant features of the stride adjustment mechanism 166 is a dynamic link, that is, a linkage system that changes its length, or the distance between its two attachment points, cyclically during the motion of the apparatus 10. The stride adjustment mechanism 166 is pivotally attached to the pedal lever 50 by a link crank mechanism 168 at one end and pivotally attached to the crank extension 72 at the other end. The maximum pedal lever's 50 excursion, for a particular setting, is called a stroke or stride. The stride adjustment mechanism 166 and the main crank 68 with the crank extension 72 together drive the maximum displacement/stroke of the pedal lever 50. The extreme points in each pedal lever stroke correspond to extreme points between the Main Crank Axis 40 and a Link Crank—Pedal Lever Axis 169. By changing the dynamic phase angle relationship between the link crank 168 and the crank extension 72, it is possible to add to or subtract from the maximum displacement/stroke of the pedal lever 50. Therefore by varying the dynamic phase angle relationship between the link crank 168 and the crank extension 72, the stroke or stride of the pedal lever 50 varies the length of the major axis of the ellipse that the foot pedal 12 travels.

Figure 4:
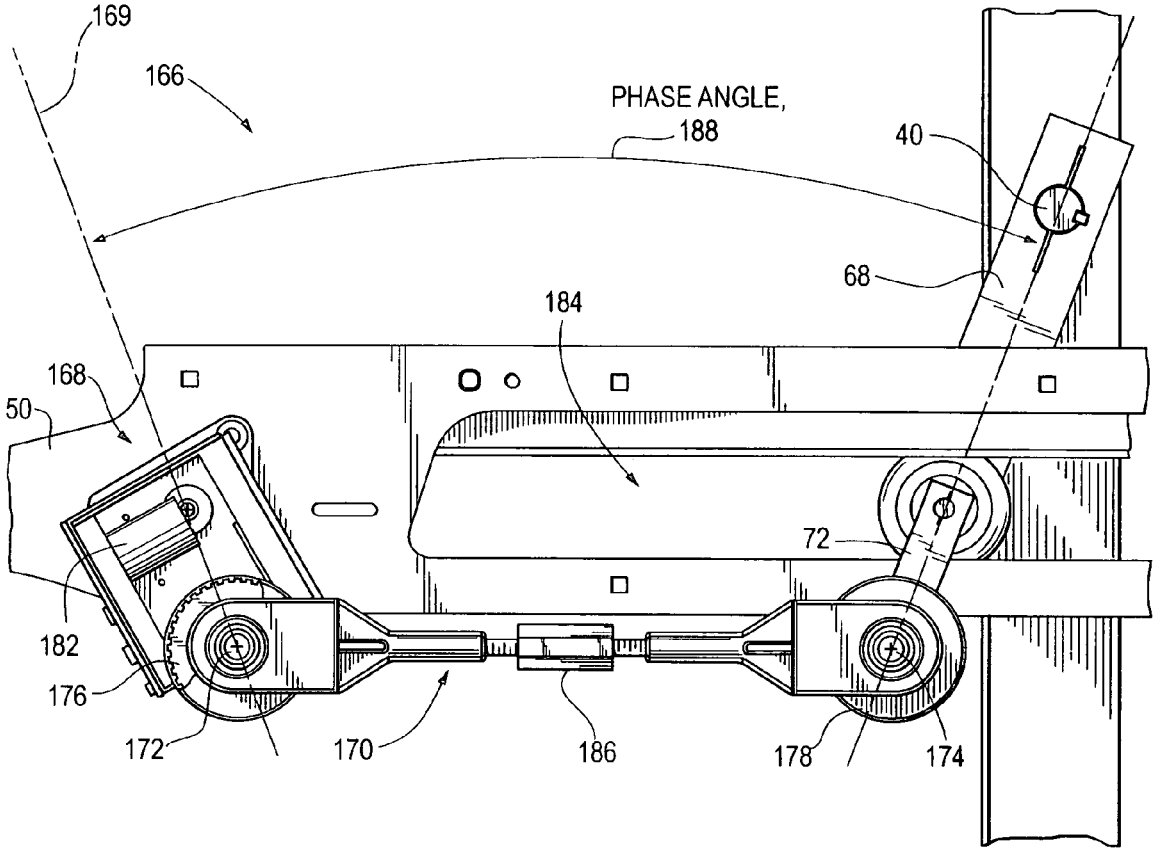
FIGS. 4 and 5 are views of a mechanism for use in adjusting stride length in an elliptical stepping apparatus of the type shown in FIG. 1.
Figure 5:
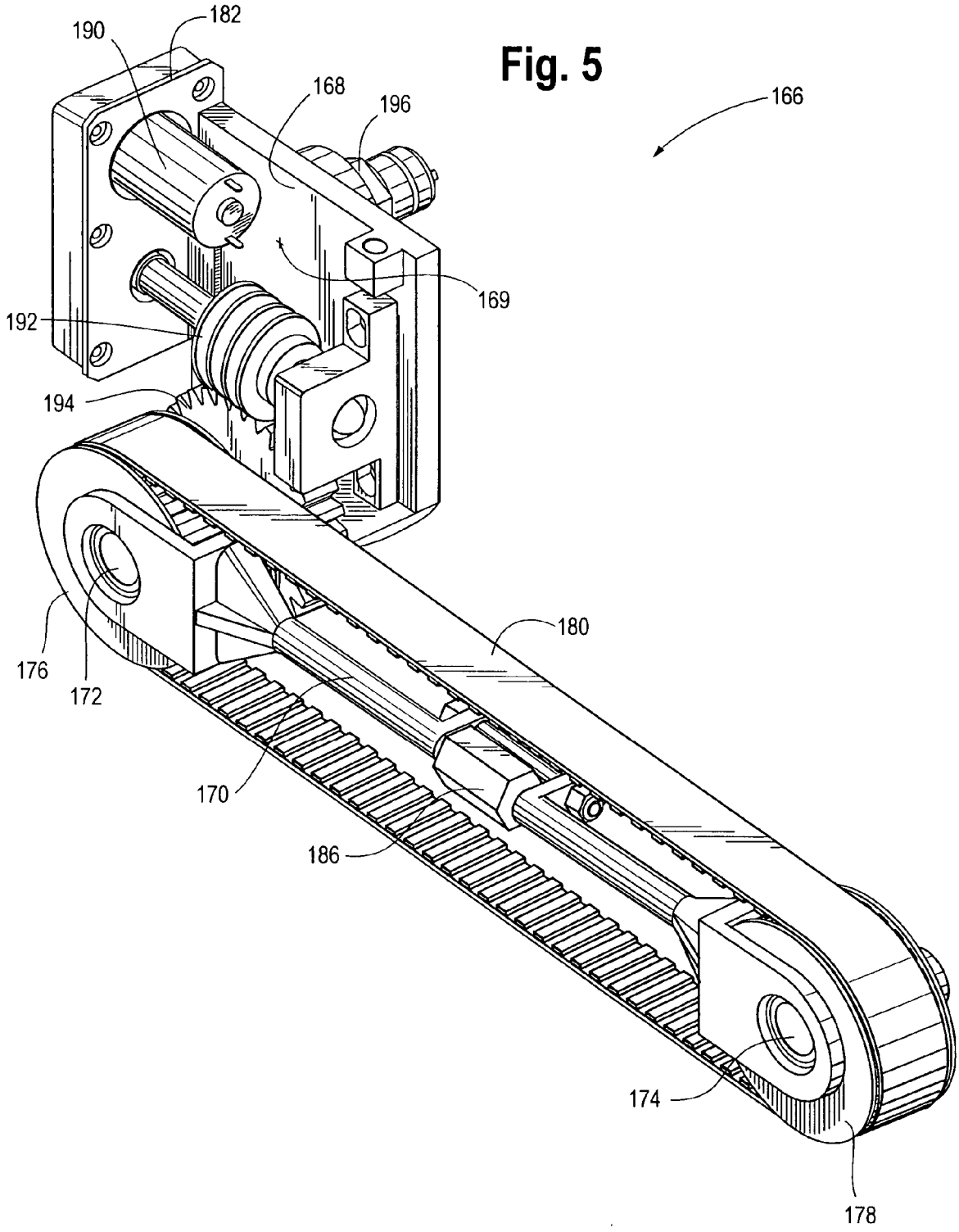

The preferred embodiment of the stride adjustment mechanism 166 shown in FIGS. 4 and 5 takes full advantage of the relative rotation between the crank extension 72 and a control link assembly 170 of the stride adjustment mechanism 166 as the user moves the pedals 12. In this embodiment, attachment adjustment mechanism 166 includes the control link assembly 170 and two secondary crank arms, the link crank assembly 168 and the crank extension 72. The control link assembly 170 includes a pair of driven timing-pulley shafts 172 and 174, a pair of toothed timing-pulleys 176 and 178 and a toothed timing-belt 180 engaged with the timing pulleys 176 and 178. For clarity, the timing belt is not shown in FIG. 4 but is shown in FIG. 5. Also included in the link crank assembly 168 is a link crank actuator 182. One end of the crank-extension 72 is rigidly attached to the main crank 68. The other end of the crank-extension 72 is rigidly attached to the rear driven timing-pulley shaft 174 and the pulley 178. Also, the rear driven timing-pulley shaft 174 is rotationally attached to the rearward end of the control link assembly 170. The forward end of the control link assembly 170 is rotationally attached to the forward driven timing-pulley shaft 172 and pulley 176. The two timing-pulleys 176 and 178 are connected to each other via the timing-belt 180. The forward driven timing-pulley shaft 172 is pivotally attached to the link crank 168, but held in a fixed position by the link crank actuator 182 when the actuator 182 is stationary; the link crank 168 operates as if it were rigidly attached to the forward driven timing-pulley shaft 172. The other end of the link crank 168 is pivotally attached to the pedal lever 50 at the pivot axle 169. In this particular embodiment of the elliptical step apparatus 10 shown in FIGS. 4 and 5, the main crank 68 via a revolute joint on a linear slot supports the rearward end of the pedal lever 50. Here, this is in the form of a roller & track interface indicated generally at 184. When the apparatus 10 is put in motion, there is relative rotation between the crank extension/rearward timing-pulley 178 and the control link 170. This timing-pulley rotation drives the forward driven timing-pulley 176 via the timing-belt 180. Since the forward driven timing-pulley 176 is rigidly attached to one end of the link crank 168, the link crank 168 rotates relative to the pedal lever 50. Because the control link 170 is a rigid body, the rotation of the link crank 168 moves the pedal lever 50 in a prescribed motion on its support system 184. In order to facilitate installation, removal and tension adjustment of the belt 180 on the pulleys 176 and 178, the control link 170 includes an adjustment device such as a turnbuckle 186 that can be used to selectively shorten or lengthen the distance between the pulleys 176 and 178.

In this mechanism 166, there exists a relative angle indicated by an arrow 188 shown in FIG. 4 between the link crank 202 and the crank extension 70. This relative angle 188 is referred to as the LC-CE phase angle. When the link crank actuator 182 is stationary, the LC-CE phase angle 188 remains constant, even if the machine 10 is in motion. When the actuator 182 is activated, the LC-CE phase angle 188 changes independent of the motion of the machine 10. Varying the LC-CE phase angle 188 effects a change in the motion of the pedals 10, in this case, changing the stride length.

In the embodiment, shown in FIG. 5, the link crank actuator 182 includes a gear-motor, preferably an integrated motor and gearbox 190, a worm shaft 192, and a worm gear 194. Because the link crank actuator 190 rotates about an axis relative to the pedal lever 50, a conventional slip-ring type device 196 is preferably used to supply electrical power, from for example the power control board 94 shown in FIG. 2, across this rotary interface to the DC motor of the gear-motor 190. When power is applied to the gear-motor 190, the worm shaft 192 and the worm gear 194 rotate. The rotating worm shaft 192 rotates the worm gear 194, which is rigidly connected to the driven timing pulley 176. In addition, the worm gear 194 and the forward pulley 176 rotate relative to the link crank 168 to effect the LC-CE Phase Angle 188 change between the crank extension 72 and the link crank 168. A reverse phase angle change occurs when the motor 190 is reversed causing a reverse stride change, that is, a decrease in stride length. In this embodiment, less than half of the 360 degrees of the possible phase angle relationship between the link crank 168 and the crank extension 72 is used. In some mechanisms using more or the full range of possible phase angles can provide different and desirable ellipse shapes.

Figure 6A:
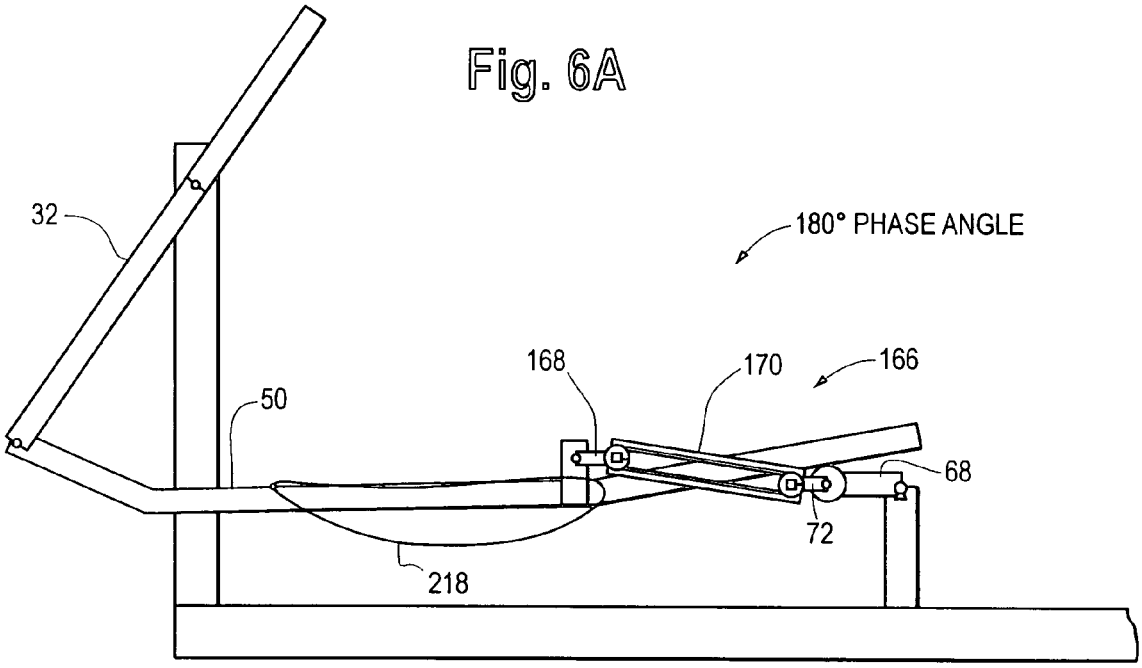
FIGS. 6A, 6B, 6C and 6D are schematic diagrams illustrating the operation of the mechanism of FIGS. 4 and 5 for a 180 degree phase angle.
Figure 6B:
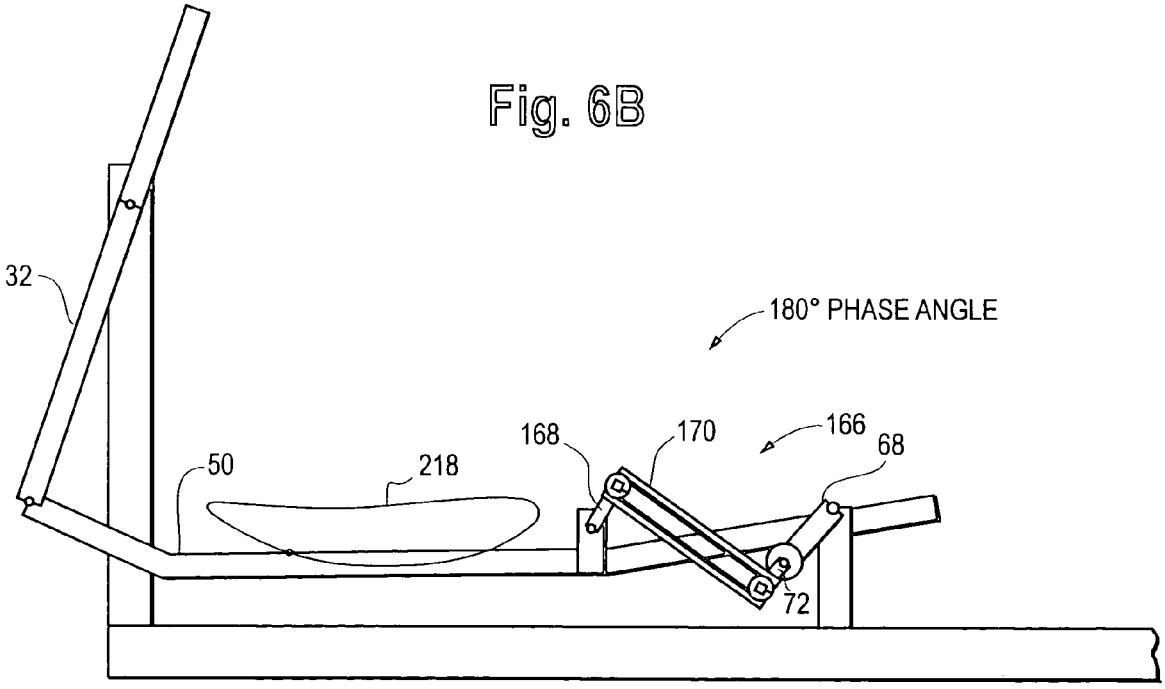
Figure 6C:
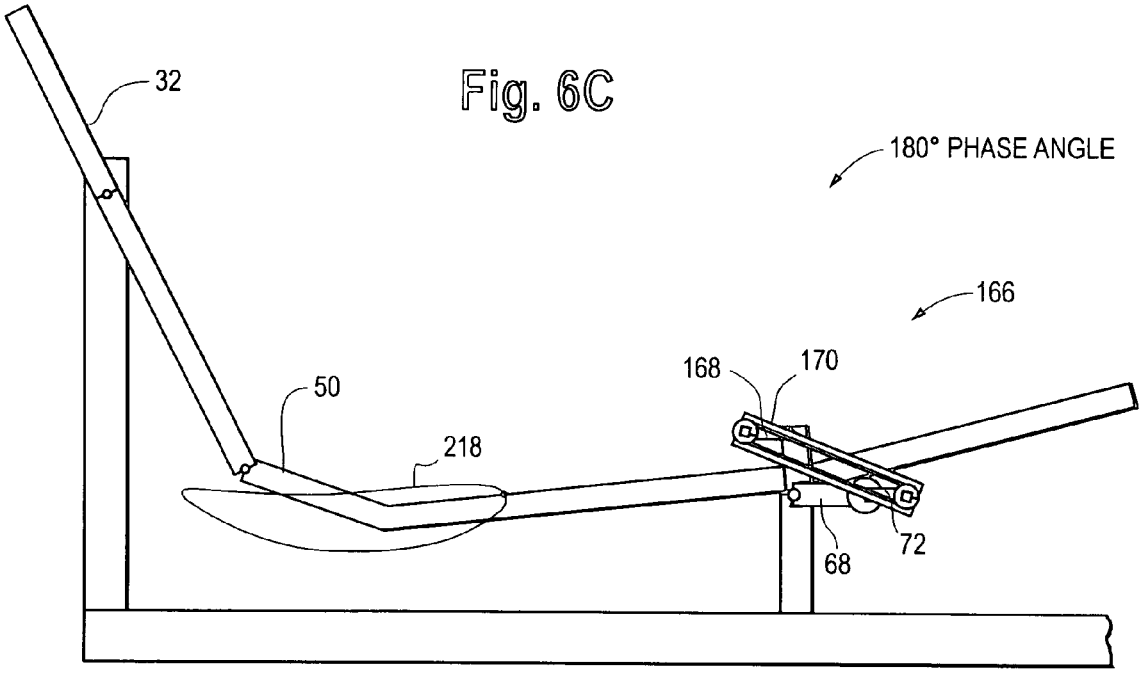
Figure 6D:
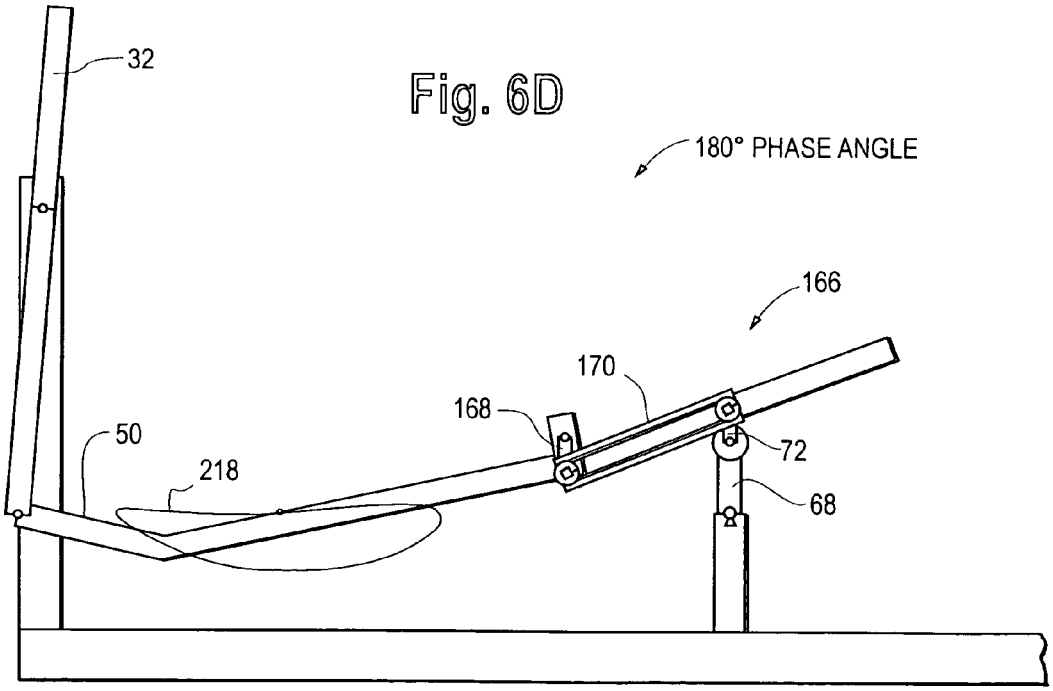
Figure 7A:
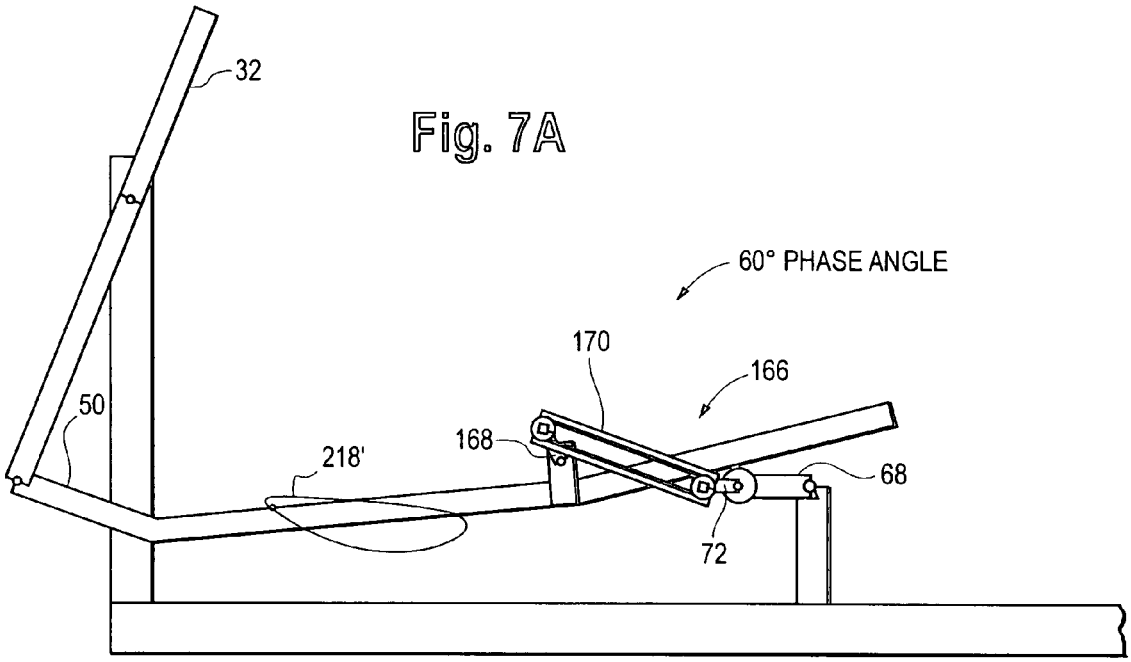
FIGS. 7A, 7B, 7C and 7D are schematic diagrams illustrating the operation of the mechanism of FIGS. 4 and 5 for a 60 degree phase angle.
Figure 7B:
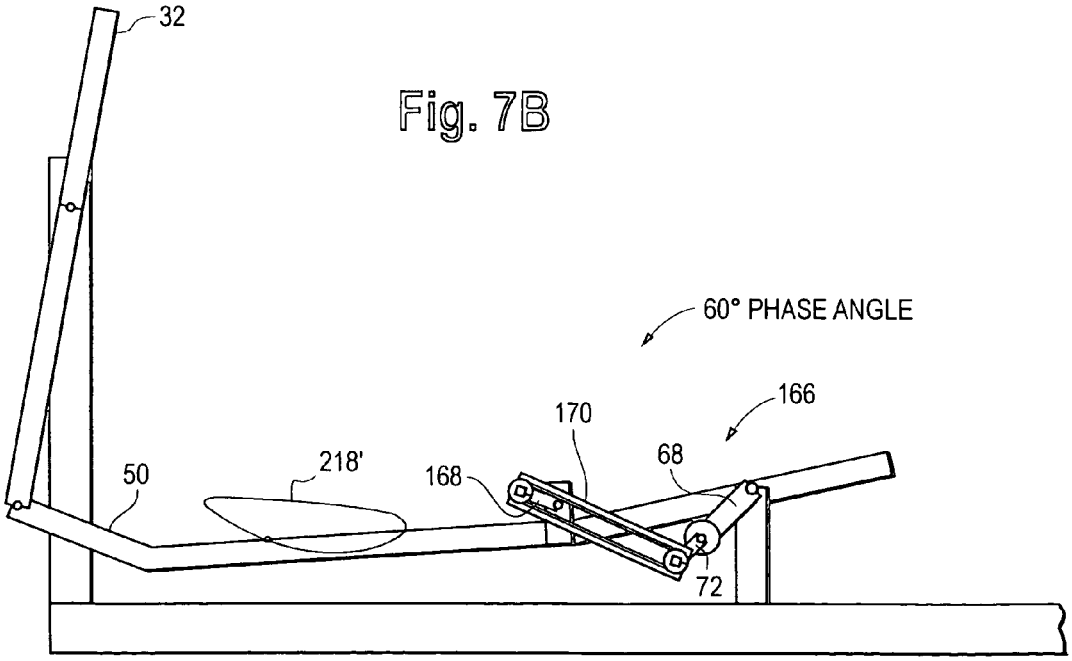
Figure 7C:
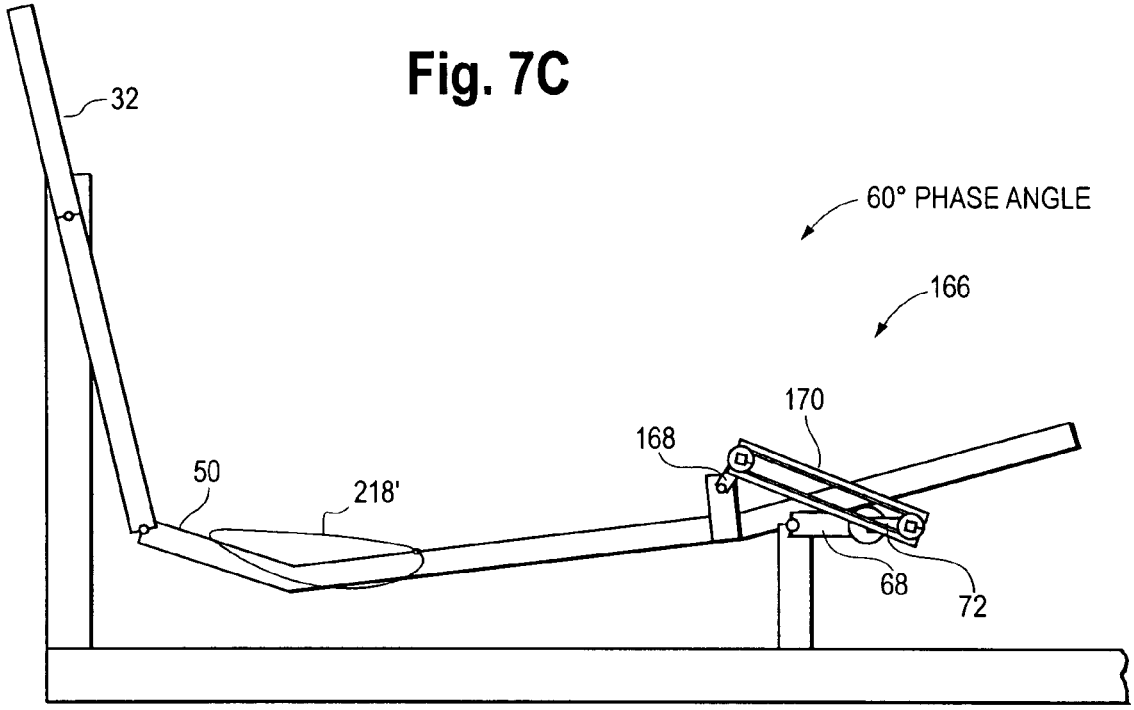
Figure 7D:
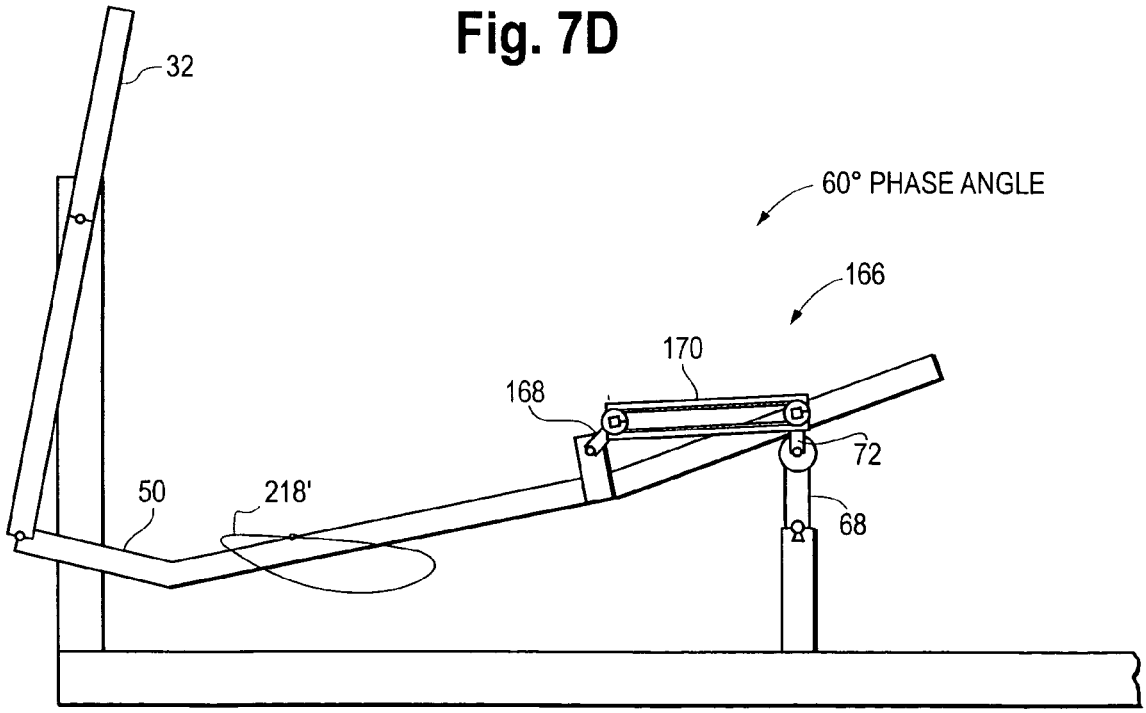
Figure 8A:
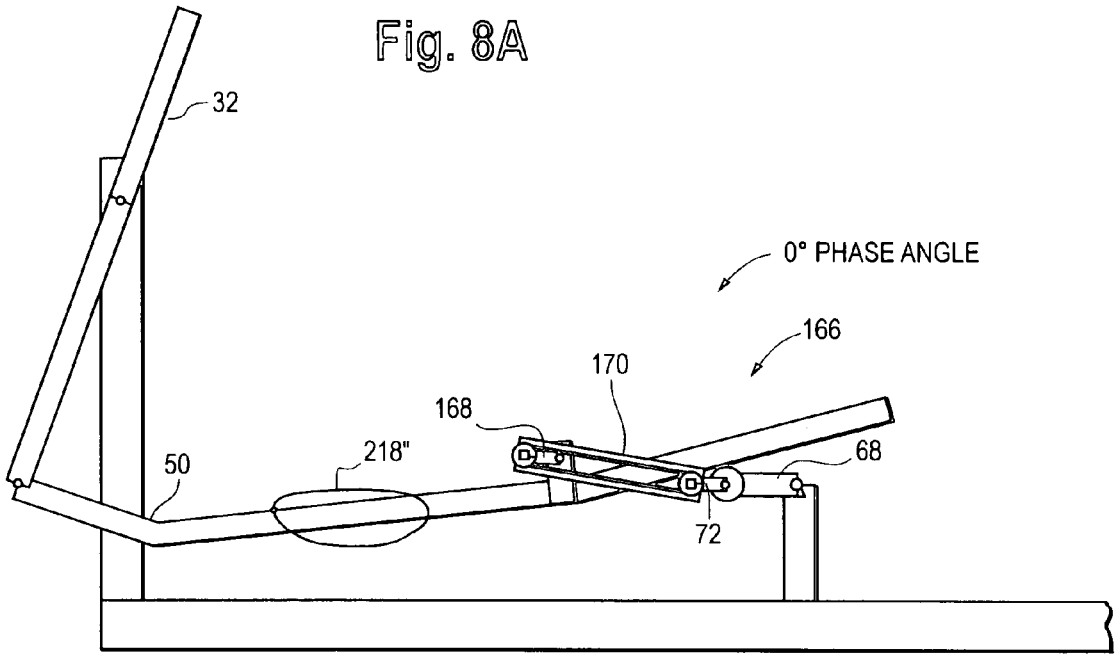
FIGS. 8A, 8B, 8C and 8D are schematic diagrams illustrating the operation of the mechanism of FIGS. 4 and 5 for a zero degree phase angle.
Figure 8B:
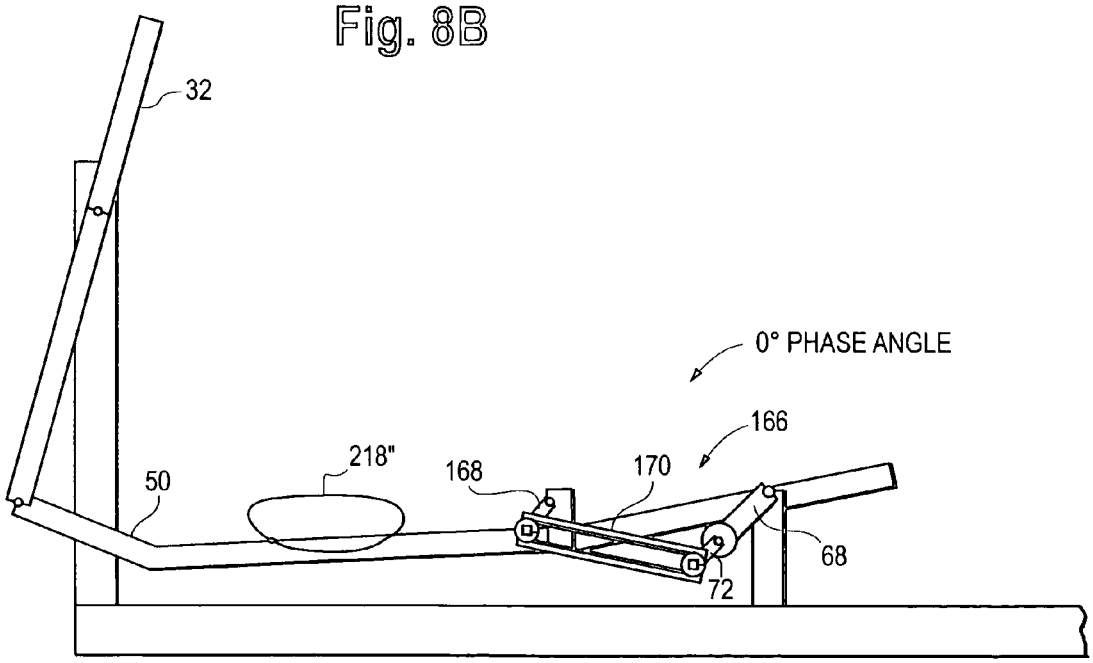
Figure 8C:
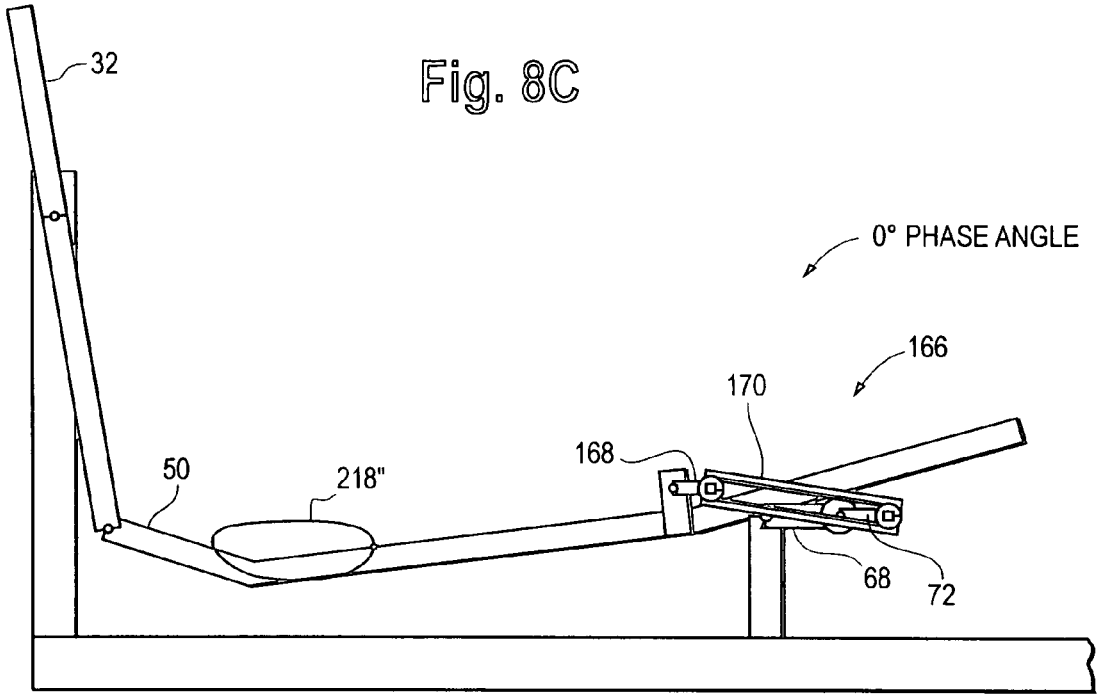
Figure 8D:
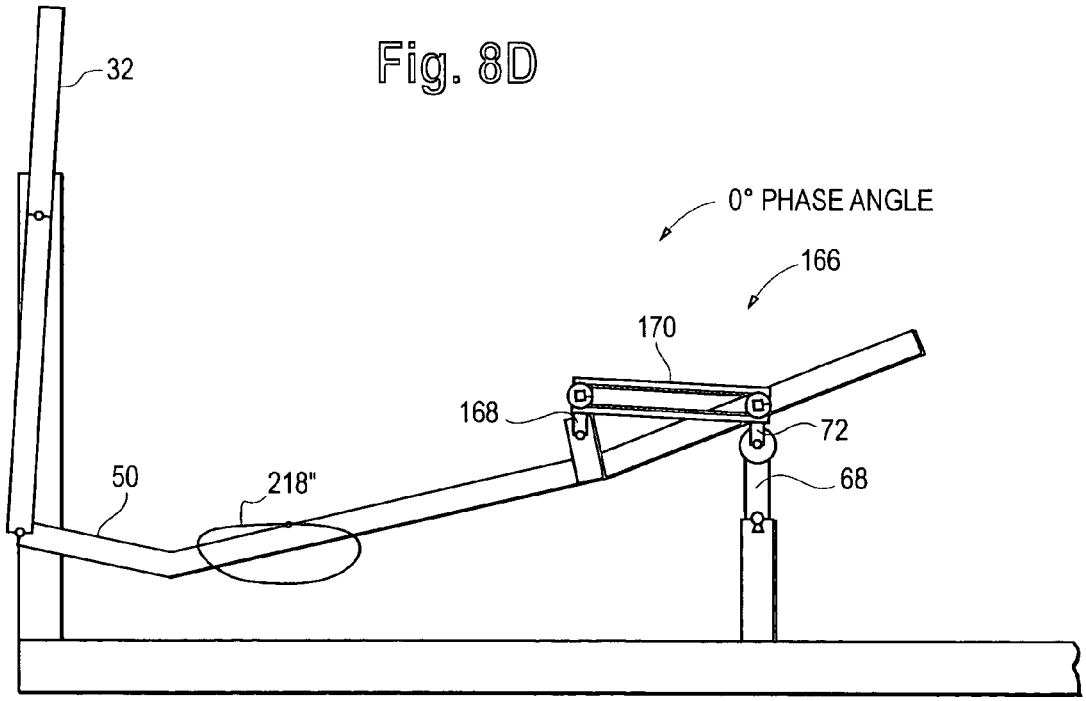
Figure 9A:
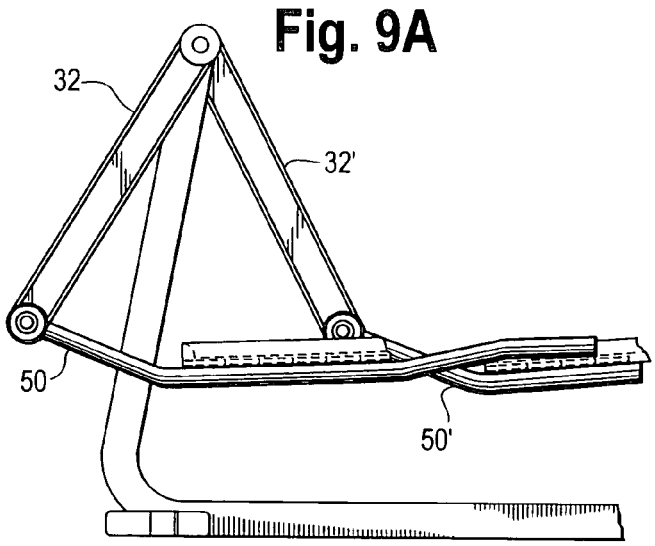
FIGS. 9A, 9B and 9C are a set of schematic diagrams illustrating angle measurements that can be used to determine stride length in an elliptical stepping apparatus of the type shown in FIG. 1.
Figure 9B:
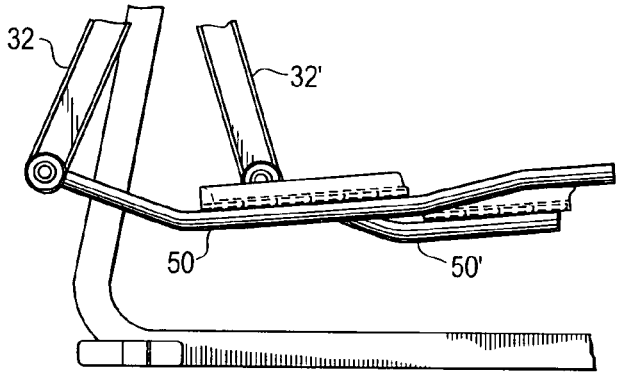
Figure 9C:
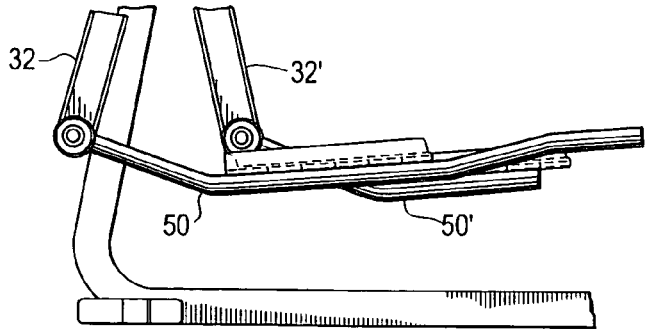

The schematics of FIGS. 6A-D, 7A-D and 8A-D illustrate the effect of the phase angle change between the crank extension 72 and the link crank 168 for a 180 degree, a 60 degree and a 0 degree phase relationship respectively. Also, FIGS. 6A, 7A, and 8A display the crank at 180 degree position; FIGS. 6B, 7B, and 8B show the crank at 225 degree position; FIGS. 8C, 9C, and 10C show the crank at a 0 degree position; and FIGS. 8D, 9D, and 10D show the crank at a 90 degree position. In FIGS. 6A-D the elliptical path 218 represents the path of the pedal 12 for the longest stride; in FIGS. 7A-D the elliptical path 218' represents the path of the pedal 12 for an intermediate stride; and in FIGS. 8A-D the elliptical path 218" represents the path of the pedal 12 for the shortest stride.

In certain circumstances, characteristics of stride adjustment mechanism of the type 166 can result in some undesirable effects. Therefore, it might be desirable to implement various modifications to reduce the effects of these phenomena. For example, when the stride adjustment mechanism 166 is adjusted to the maximum stroke/stride setting, the LC-CE Phase Angle is 180 degrees. At this 180-degree LC-CE Phase Angle setting, the components of the stride adjustment mechanism 166 will pass through a collinear or toggle condition. This collinear condition occurs at or near the maximum forward excursion of the pedal lever 50, which is at or near a maximum acceleration magnitude of the pedal lever 50. At slow pedal speeds, the horizontal acceleration forces are relatively low. As pedal lever speeds increase, effects of the condition increase in magnitude proportional to the change in speed. Eventually, this condition can produces soft jerk instead of a smooth transition from forward motion to rearward motion. To overcome this potential problem several approaches can be taken including: limit the maximum LC-CE phase angle 188 to less than 180 degrees, for example, restrict stride range to 95% of mechanical maximum; change the prescribed path shape 218 of the foot pedal 12; or reduce the mass of the moving components in the stride adjustment mechanism 166 and the pedal levers 50 to reduce the acceleration forces.

Another problem can occur when the stride adjustment mechanism 166 is in motion and where the tension side of the timing-belt 180 alternates between the top portion and the lower portion. This can be described as the tension in the belt 180 changing cyclically during the motion of the mechanism 166. At slow speeds, the effect of the cyclic belt tension magnitude is relatively low. At higher speeds, this condition can produce a soft bump perception in the motion of the machine 10 as the belt 180 quickly tenses and quickly relaxes cyclically. Approaches to dealing with this belt tension problem can include: increase the timing-belt tension using for example the turnbuckle 186 until the bump perception is dampened; increase the stiffness of the belt 180; increase the bending stiffness of the control link assembly 170; and install an active tensioner device for the belt 180.

A further problem can occur when the stride adjustment mechanism 166 is in motion where a vertical force acts on the pedal lever 50. The magnitude of this force changes cyclically during the motion of the mechanism 10. At long strides and relatively high pedal speeds, this force can be sufficient to cause the pedal lever 50 to momentarily lift off its rearward support roller 70. This potential problem can be addressed in a number of ways including: the roller-trammel system 184, as shown in FIG. 4; limit the maximum LC-CE phase angle 188 to less than 180 degrees; restrict stride range to 95% of mechanical maximum; and reduce the mass of the moving components in the stride adjustment mechanism and the pedal levers.

Elliptical Step Programs

Figure 10:
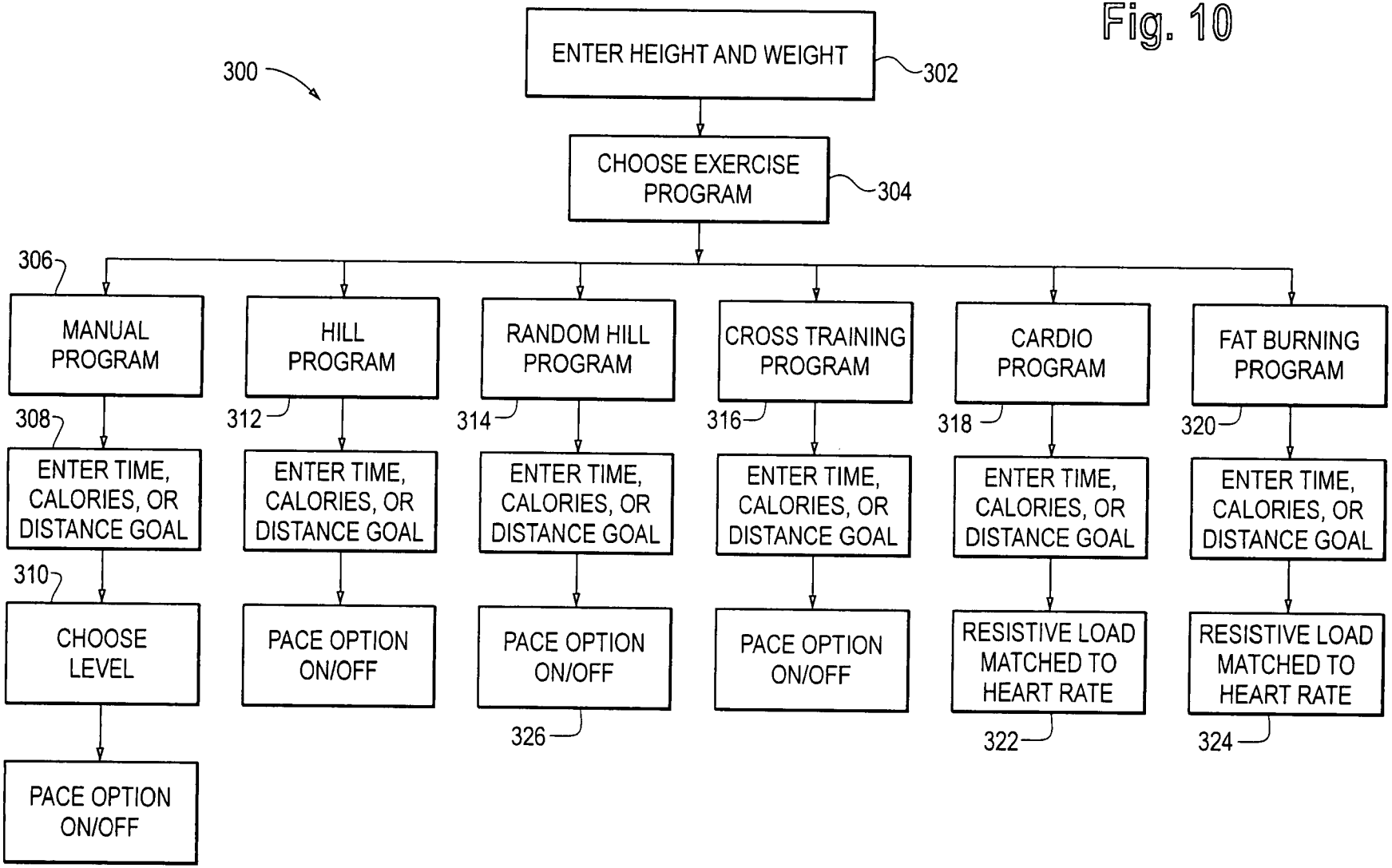
FIG. 10 is a flow diagram illustrating the operation of exercise program operations in an apparatus of the type shown in FIG. 1.

As shown in FIG. 10, the exercise apparatus 10 can provide several pre-programmed exercise programs that can be used with a static or an adjustable stride length. In this embodiment of the invention a set of exercise programs 300 are stored within and implemented by the microprocessor 92. The exercise programs 300 provide for a variable exercise and can enhance exercise efficiency. In this embodiment, the alpha-numeric display screen 112 of the message center 110, together with a display panel 136, guide the user through the various exercise programs. Specifically, the alpha-numeric display screen 112 prompts the user to select among the various pre-programmed exercise programs 300 and prompts the user to supply the data as indicated at a box 302 that can be useful in implementing the exercise program selected at a box 304. The display panel 136 displays a graphical image that represents the current exercise program. One of the most basic exercise programs is a manual exercise program indicated at 306. In the manual exercise program 306 the user, after entering a time, calorie or distance goal as indicated the first of a set of boxes indicated by 308, selects one of the twenty-four previously described exercise levels at 310. In this case, the graphic image displayed by the display panel 136 is essentially flat and the different exercise levels are distinguished as vertically spaced-apart flat displays. A second exercise program 312, a hill profile program, varies the effort required by the user in a pre-determined fashion which is designed to simulate movement along a series of hills. In implementing this program 312, the microprocessor 92 increases and decreases the resistive force of the alternator 42 thereby varying the amount of effort required by the user. The display panel 136 displays a series of vertical bars of varying heights that correspond to climbing up or down a series of hills. A portion 138 of the display panel 136 displays a single vertical bar whose height represents the user's current position on the displayed series of hills. A third exercise program 314, termed the random hill profile program, also varies the effort required by the user in a fashion which is designed to simulate movement along a series of hills. However, unlike the regular hill profile program 312, the random hill profile program 314 provides a randomized sequence of hills so that the sequence varies from one exercise session to another. A detailed description of a random hill profile program and of the regular hill profile program can be found in U.S. Pat. No. 5,358,105, the entire disclosure of which is hereby incorporated by reference.

A fourth exercise program 316, termed a cross training program, instructs the user to move the pedal 12 in both the forward-stepping mode and the backward-stepping mode. When this program 316 is selected by the user, the user begins moving the pedal 12 in one direction, for example, in the forward direction. After a predetermined period of time, the alpha-numeric display panel 136 prompts the user to prepare to reverse directions. Thereafter, the field control signal 100 from the microprocessor 92 is varied to effectively brake the motion of the pedal 12 and the arm 80. After the pedal 12 and the arm 80 stop, the alpha-numeric display screen 112 prompts the user to resume his workout. Thereafter, the user reverses directions and resumes his workout in the opposite direction.

A pair of exercise programs, a cardio program 318 and a fat burning program 320, vary the resistive load of the alternator 42 as a function of the user's heart rate. When the cardio program 318 is selected, the microprocessor 92 varies the resistive load as shown at 322 so that the user's heart rate is maintained at a value equivalent to 80% of a quantity equal to 220 minus the user's age. In the fat burning program 320, the resistive load is varied as shown at 324 so that the user's heart rate is maintained at a value equivalent to 65% of a quantity equal to 220 minus the user's heart age. Consequently, when either of these programs 318 or 320 is selected by the user at 304, the alpha-numeric display screen 112 prompts the user to enter his age as one of the program parameters. Alternatively, the user can enter a desired heart rate. In addition, the exercise apparatus 10 includes a heart rate sensing device that measures the users heart rate as he exercises. In the apparatus shown in FIG. 2, the heart rate sensing device consists a pair of heart rate sensors 140 and 140' that can be mounted either on the moving arms 80 or a fixed handrail 142, as shown in FIG. 1. In the preferred embodiment, the sensors 140 and 140' are mounted on the moving arms 80. A set of output signals on the lines 144 and 144' corresponding to the user's heart rate is transmitted from the sensors 140 and 140' to a heart rate digital signal processing board 146. The processing board 146 then transmits a heart rate signal over a line 148 to the microprocessor 92. A detailed description of the sensors 140 and 140' and the heart rate digital signal processing board 146 can be found in U.S. Pat. Nos. 5,135,447 and 5,243,993, the entire disclosures of which are hereby incorporated by reference. In addition, the exercise apparatus 10 includes a telemetry receiver 150, shown in FIG. 2, that operates in an analogous fashion and transmits a telemetric heart rate signal over a line 152 to the microprocessor 92. The telemetry receiver 150 works in conjunction with a telemetry transmitter that is worn by the user. In the preferred embodiment, the telemetry transmitter is a telemetry strap worn by the user around the user's chest, although other types of transmitters are possible. Consequently, the exercise apparatus 10 can measure the user's heart rate through the telemetry receiver 150 if the user is not grasping the arm 80. Once the heart rate signal 148 or 152 is transmitted to the microprocessor 92, the resistive load 96 of the alternator 42 is varied to maintain the user's heart rate at the calculated value.

In each of these exercise programs, the user provides data at 308 that determine the duration of the exercise program. The user can select between a number of exercise goal types including a time or a calories goal or, in the preferred embodiment of the invention, a distance goal. If the time goal type is chosen, the alpha-numeric display screen 112 prompts the user to enter the total time that he wants to exercise or, if the calories goal type is selected, the user enters the total number of calories that he wants to expend. Alternatively, the user can enter the total distance either in miles or kilometers. The microprocessor 92 then implements the selected exercise program for a period corresponding to the user's goal. If the user wants to stop exercising temporarily after the microprocessor 92 begins implementing the selected exercise program, depressing the clear/pause key 120 effectively brakes the pedal 12 and the arm 80 without erasing or changing any of the current program parameters. The user can then resume the selected exercise program by depressing the start/enter key 118. Alternatively, if the user wants to stop exercising altogether before the exercise program has been completed, the user simply depresses the brake key 108 to brake the pedal 12 and the arm 80. Thereafter, the user can resume exercising by depressing the start/enter key 118. In addition, the user can stop exercising by ceasing to move the pedal 12. The user then can resume exercising by again moving the pedal 12.

The exercise apparatus 10 also includes a pace option as depicted by a set of boxes indicated at 326. In all but the cardio program 318 and the fat burning program 320, the default mode is defined such that the pace option is on and the microprocessor 92 varies the resistive load of the alternator 42 as a function of the user's pace. When the pace option is on, the magnitude of the RPM signal 102 received by the microprocessor 92 determines the percentage of time during which the field control signal 100 is enabled and thereby the resistive force of the alternator 42. In general, the instantaneous velocity as represented by the RPM signal 102 is compared to a predetermined value to determine if the resistive force of the alternator 42 should be increased or decreased. In the presently preferred embodiment, the predetermined value is a constant of 30 RPM. Alternatively, the predetermined value could vary as a function of the exercise level chosen by the user. Thus, in this embodiment, if the RPM signal 102 indicates that the instantaneous velocity of the pulley 38 is greater than 30 RPM, the percentage of time that the field control signal 100 is enabled is increased according to Equation 1.

$$\text{field control duty cycle} = \text{field control duty cycle} + \frac{((|\text{instantaneous } RPM - 30|)/2)^2 * \text{field control duty cycle})}{256} \quad \text{Equation 1}$$

where field duty cycle is a variable that represents the percentage of time that the field control signal 100 is enabled and where the instantaneous RPM represents the instantaneous value of the RPM signal 98.

On the other hand, in this embodiment, if the RPM signal 102 indicates that the instantaneous velocity of the pulley 38 is less than 30 RPM, the percentage of time that the field control signal 100 is enabled is decreased according to Equation 2.

$$\text{field control duty cycle} = \text{field control duty cycle} - \frac{((|\text{instantaneous } RPM - 30|)/2)^2 * \text{field control duty cycle})}{256} \quad \text{Equation 2}$$

where field duty cycle is a variable that represents the percentage of time that the field control signal 100 is enabled and where the instantaneous RPM represents the instantaneous value of the RPM signal 102.

Moreover, once the user selects an exercise level, the initial percentage of time that the field control signal 100 is enabled is pre-programmed as a function of the chosen exercise level as described in U.S. Pat. No. 6,099,439.

Manual and Automatic Stride Length Adjustment

In these embodiments of the invention, stride length can be varied automatically as a function of exercise or apparatus parameters. Specifically, the control system 88 and the console 90 of FIG. 2 can be used to control stride length in the elliptical step exercise apparatus 10 either manually or as a function of a user or operating parameter. In the examples of FIGS. 1 and 2 the attachment assembly 34 generally represented within the dashed lines can be implemented by a number of mechanisms that provide for stride adjustment such as the stride length adjustment mechanism depicted in FIGS. 4 and 5. As shown in FIG. 2, a line 154 connects the microprocessor 92 to the electronically controlled actuator elements of the adjustment mechanisms in the attachment assembly 34. Stride length can then be varied by the user via a manual stride length key 156, shown in FIG. 3, which is connected to the microprocessor 92 via the data input center 104. Alternatively, the user can have stride length automatically varied by using a stride length auto key 158 that is also connected to the microprocessor 92 via the data input center 104. In one embodiment, the microprocessor 92 is programed to respond to the speed signal on line 102 to increase the stride length as the speed of the pedal 12 increases. Pedal direction, as indicated by the speed signal can also be used to vary stride length. For example, if the microprocessor 92 determines that the user is stepping backward on the pedal 12, the stride length can be reduced since an individuals stride is usually shorter when stepping backward. Additionally, the microprocessor 92 can be programmed to vary stride length as function of other parameters such as resistive force generated by the alternator 42; heart rate measured by the sensors 140 and 140'; and user data such as weight and height entered into the console 90.

Adjustable Stride Programs

Figure 11:
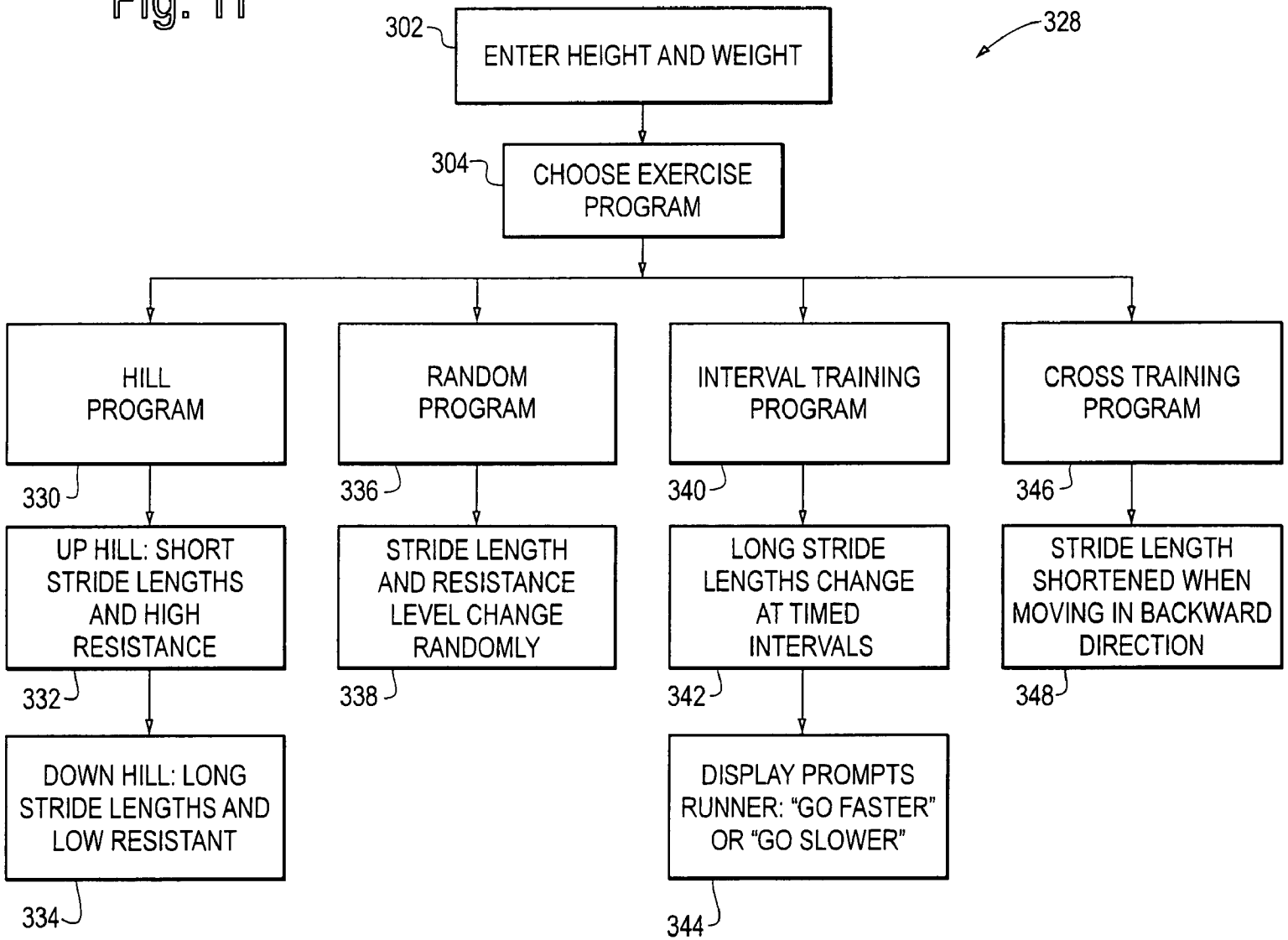
FIG. 11 is a flow diagram illustrating the operation of exercise program operations incorporating variable stride lengths in an apparatus of the type shown in FIG. 1.

As illustrated in FIG. 11, adjustable stride mechanisms make it possible to provide enhanced pre-programmed exercise programs of the type described above that are stored within and implemented by the microprocessor 92. As with the previously described exercise programs, the alpha-numeric display screen 112 of the message center 110, together with a display panel 136, can be used to guide the user through the various exercise programs. Again, the alpha-numeric display screen 112 prompts the user to select at 304 among the various preprogrammed exercise programs and prompts the user to supply the data needed to implement the selected exercise program. In this embodiment, one of a group of adjustable stride length exercise programs 328 can be selected by the user utilizing a stride program key 160, as shown in FIG. 3, which is connected to the microprocessor 92 via the data input center 104. As indicated above, it should be appreciated, that the control and display mechanisms shown in FIG. 2 only provide a representative example of such mechanisms and that there are a large number of such control and display systems that can be used to implement the invention. Representative examples of such stride length exercise programs are provided below.

A first program 330 can be used to simulate hiking on a hill or mountain similarly to the hill program 312 of FIG. 10. For example, the program can begin with short strides and a high resistance to simulate climbing a hill then as shown in a box 332 after a predetermined time change to long strides at low resistance as indicated at a box 334 to simulate walking down the hill. The current hill and upcoming hills can be displayed on the display panel 136 where the length of the stride and the resistance change at each peak and valley. In one implementation, the initial or up hill stride would be 16 inches and the down hill stride would be 24 inches, where the program automatically adjusts the initial stride length to 16 inches at the beginning of the program. Also, the program can return the stride length to a home position, for instance 20 inches, during a cool down portion of the program.

A second program 336 can be used to change both the stride length and the resistance levels on a random basis. Preferably, the changes in stride length and resistance levels are independent of each other as indicated at a box 338. Also in one embodiment, the changes in stride length occur at different time intervals than the changes in resistance levels. For example, a random stride length change might occur every even minute and a random resistance level change might occur at every odd minute of the program. Preferably, the changes in increments will be plus or minus 2 inches or more. Again, the program can return the stride length to a home position, for instance 20 inches, during a cool down portion of the program.

A third program 340 can be used to simulate interval training for runners. In one embodiment, by using stride length changes in the longer strides and having the processor 92 generates motivating message prompts on the display 136, interval training and the gentle slopes and intervals one would experience when training as a runner outdoors are mimicked. In one example, as indicated in a box 342, the program spans the stride range of 22"-26" with an initial warm-up beginning at 22" then moving to 24". Here the program then alternates between the 24" and 26" strides thus mimicking intervals at the longer strides such as those experienced by a runner in training. In addition as indicated in a box 344, the display 136 can be used to alert the user to "Go faster" and "Go slower" at certain intervals. Thus the prompts can be used to encourage faster and slower pedal speeds. A representative example of such a program is provided below:

Warm-up:
Prompt "Warm Up" message
Minute 00:00=22" stride (If machine is not at 22" at program start-up, then it will adjust to the 22" stride length at program start.)
Minute 03:00=24" stride
Minute 03:30=prompt "Go faster" message
Intervals:
Minute 04:00=26" stride
Minute 08:30=prompt "Go slower" message
Minute 09:00=24" stride
Minute 10:30=prompt "Go faster" message
Minute 11:00=26" stride
Minute 15:30=prompt "Go slower" message where the first change is initiated at the 03:00 minute mark, during the warm-up phase. Other aspects of this particular interval program include: stride adjustment increments of 2"; minimum duration of 10 minutes; and repeating the interval phase for the selected duration of the program.

A fourth program 346 can be used to simulate a cross training exercise. Here, as shown in a box 348, stride length is shortened when the user is pedaling in a backward direction and increased when the user is pedaling in a forward direction. As with the interval training program 340, the display 136 can be used in the cross training program 346 to generate indications to the user at a predetermined time, such as 30 seconds, before the direction of pedal motion is to change.

We claim:

1. An exercise apparatus comprising:

a step mechanism including a first pedal and a second pedal wherein said step mechanism effective to cause said pedals to move in a substantially elliptical path having a vertical component and a substantially horizontal component that corresponds generally to user stride length;

a stride length adjustment mechanism operatively connected to said step mechanism;

a control system, including a processor, operatively connected to said step mechanism and said stride length adjustment mechanism;

a user input and display system, operatively connected to said control system, including a plurality of input keys to permit a user to input information into said control system and at least one display for displaying exercise data;

a pedal speed sensor operatively connected to said control system;

program logic associated with said control system effective to cause said stride length to increase with increased speed of said pedals; and wherein said speed sensor additionally senses the direction of movement of said pedals and said program logic is effective to cause said stride length to change with the direction of movement of said pedals.

2. The apparatus of claim 1 wherein said change is a decrease in stride length when said direction of movement of said pedals is backwards.

3. The apparatus of claim 1 additionally including a resistive force generator operatively connected to said step mechanism and said control system for generating a resistive force to the movement of said pedals and wherein said program logic is effective to change stride length as a function of said resistive force.

4. The apparatus of claim 3 wherein said change is a decrease in stride length when said resistive force increases.

5. The apparatus of claim 1 additionally including a resistive force generator operatively connected to said step mechanism and said control system for generating a resistive force to the movement of said pedals and wherein said program logic includes at least one exercise program.

6. The apparatus of claim 5 wherein said exercise program is a hill program wherein said resistive force increases and the stride length decreases as the user climbs a simulated hill.

7. The apparatus of claim 5 wherein said exercise program is a random program wherein said resistive force increases and decreases and the stride length increases and decreases randomly.

8. The apparatus of claim 5 wherein said exercise program is an interval program wherein the stride length is increased at predetermined intervals.

9. The apparatus of claim 8 wherein said interval program causes said display to display a message to a user to pedal faster when said stride length is increased.

10. The apparatus of claim 5 wherein said speed sensor additionally senses the direction of movement of said pedals and wherein said exercise program is a cross training program wherein the stride length is increased when a user is pedaling in the forward direction and decreased when the user is pedaling in the backward direction.

11. An exercise apparatus comprising:

a step mechanism including a first pedal and a second pedal wherein said step mechanism effective to cause said pedals to move in a substantially elliptical path having a vertical component and a substantially horizontal component that corresponds generally to user stride length;

a stride length adjustment mechanism operatively connected to said step mechanism;

a control system, including a processor, operatively connected to said step mechanism and said stride length adjustment mechanism;

a user input and display system, operatively connected to said control system, including a plurality of input keys to permit a user to input information into said control system and at least one display for displaying exercise data;

a pedal speed sensor operatively connected to said control system;

a resistive force generator operatively connected to said step mechanism and said control system for generating a resistive force to the movement of said pedals program logic associated with said control system effective to cause the stride length to increase and decrease according to an exercise program and wherein a user can utilize said keys to select said exercise program; and wherein said speed sensor additionally senses the direction of movement of said pedals and wherein said exercise program is a cross training program wherein the stride length is increased when a user is pedaling in the forward direction and decreased when the user is pedaling in the backward direction and wherein said display displays a first direction prompt a first predetermined time before the stride length is increased and displays a second direction prompt a second predetermined time before the stride length is decreased.

12. The apparatus of claim 11 wherein said exercise program simulates climbing a hill wherein the stride length is decreased and said resistance is increased in a hill climbing portion of said exercise program and said stride length is increased and said resistance is decreased for a descending portion of said exercise program.

13. The apparatus of claim 12 wherein said display displays said hill and wherein said stride length is increased in the valleys of said hill and decreased at the peak of said hill.

14. The apparatus of claim 11 wherein said exercise program changes the stride length randomly.

15. The apparatus of claim 14 wherein said exercise program additionally changes said resistive force randomly.

16. The apparatus of claim 15 wherein said exercise program changes the stride length and said resistive force independently of each other.

17. The apparatus of claim 11 wherein said exercise program simulates interval training wherein the stride length is increased to a first predetermined length for a first predetermined amount of time and decreased to a second predetermined length for a second predetermined time.

18. The apparatus of claim 17 wherein said display displays a first speed prompt a third predetermined time before said first predetermined time and displays a second speed prompt a fourth predetermined time before said second predetermined time.

* * * * *